US005083636A

United States Patent [19]

Goldenberg

[11] Patent Number: 5,083,636

[45] Date of Patent: Jan. 28, 1992

[54] CLIMBING SAFETY NET

[75] Inventor: Frank G. Goldenberg, Lynchburg, Va.

[73] Assignee: The Safe Catch Net Co., Lynchburg, Va.

[21] Appl. No.: 593,946

[22] Filed: Oct. 9, 1990

[51] Int. Cl.[5] ..... E04G 21/32

[52] U.S. Cl. ..... 182/138; 182/82

[58] Field of Search ..... 182/138, 139, , 140, 182/142, 82

[56] References Cited

U.S. PATENT DOCUMENTS

| | | | |
|---|---|---|---|
| 132,583 | 10/1872 | Jester . | |
| 613,971 | 11/1898 | Cody . | |
| 717,666 | 1/1903 | Fahldiek . | |
| 3,949,834 | 4/1976 | Nusbaum | 182/138 |
| 4,276,959 | 7/1981 | Barber | 182/150 |
| 4,732,234 | 3/1988 | Brickman | 182/138 |
| 4,838,382 | 6/1989 | Nusbaum | 182/138 |
| 4,892,169 | 1/1990 | Duncan | 182/138 |

FOREIGN PATENT DOCUMENTS

| | | | |
|---|---|---|---|
| 1408795 | 7/1965 | France | 182/138 |
| 94002 | 5/1969 | France | 182/138 |
| 2239132 | 3/1975 | France | 182/138 |

OTHER PUBLICATIONS

Perimeter Net System, undated.

J. C. Renfroe & Sons, Inc. publication, undated.

*Primary Examiner*—Reinaldo P. Machado

*Attorney, Agent, or Firm*—Griffin, Branigan & Butler

[57] ABSTRACT

A safety net assembly (16) includes elongated rigid attachment spars (34) having attachment-spar swivel links (36) which are selectively linked to an external net support (18) at first ends thereof but which further include traction-force-responsive clamp hooks (42) at second ends thereof for selectively gripping a lower flange (58) of a steel beam (12) located adjacent an exterior of a building (10). The safety net further includes pulleys, of winches (60) for example, mountable on extra attachment spars for lifting and lowering the external net support. The elongated rigid attachment spars are disengaged from the external net support and the external net support is attached to the extra attachment spars at a new vertical location. A truss structure (66) couples adjacent lateral net support spars (22) at unit ends. Corner net units are included.

9 Claims, 5 Drawing Sheets

5083636

CLIMBING SAFETY NET

BACKGROUND OF THE INVENTION

This invention relates broadly to the art of safety nets which are externally mounted on buildings to catch persons and/or objects and debris falling from the buildings, usually during construction. More particularly, the invention relates to such safety nets which can be vertically and/or horizontally adjusted along exterior surfaces of buildings, as well as along interior surfaces of large interior spaces.

A number of safety nets which are vertically adjustable on buildings have been suggested, some of which are disclosed in U.S. Pat. Nos. 4,838,382 and 3,949,834 to Nusbaum, and 4,732,234 to Brickman. A difficulty with many of these prior-art safety net assemblies is that in order to move them vertically on buildings, which is frequently necessary, they must be detached from the buildings, substantially disassembled, reassembled and reattached at a new level. Such a procedure is not only time consuming and labor intensive, but is also complicated, requires a relatively high degree of skill, and can be dangerous. Thus, it is an object of this invention to provide a building safety net which can be vertically adjusted without being disassembled and reassembled.

Further, many prior-art building safety nets must be anchored to sides, and/or floors of buildings by lag bolts which are inserted in holes bored in walls and/or floors of the buildings. Boring and preparing such hole is time consuming and labor intensive as well as being destructive to the building. Therefore, it is another object of this invention to provide a building safety net which can be vertically adjusted usually without the necessity of boring holes in a building but yet which can be easily, quickly, and securely attached to and detached from the building.

Still other prior-art building safety nets are supported mainly on cables extending from winches, or the like, located near tops of buildings so that the safety nets can be quickly raised and lower. Although these safety nets offer the advantage of being quickly vertically adjustable, they are not particularly safe nor do they meet government requirements in that they are not securely anchored to the buildings and can therefore move laterally away from the buildings at inappropriate times. Therefore, it is still another object of this invention to provide a building safety net which can be easily vertically adjusted, but yet is securely anchored to a building once it is moved to a new vertical location.

Many prior-art safety nets comprise units which are placed side-by-side on a building to provide a long safety net at a vertical level. Once the units are in place they must be clipped together to ensure that they do not separate. This clipping, and unclipping when the net units are moved to new locations, is time consuming and can be dangerous. It is therefore an object of this invention to provide a safety net assembly for which it is not necessary to clip or otherwise attach end edges of adjacent net units together.

A related difficulty encountered when using many prior-art safety nets is that corner units are difficult to assemble and adjust. Thus, it is an object of this invention to provide a safety net assembly having a corner unit which can be adjusted vertically without disassembly thereof and which, once it is moved to a new vertical position, does not have to be reclipped or otherwise attached to adjacent net units.

It is still another object of this invention to provide a building safety net which is easily and quickly vertically adjustable, can be securely anchored, is relatively inexpensive to construct and is not unduly labor intensive to operate.

SUMMARY

According to principles of this invention a first end of each respective elongated, rigid, attachment member or spar, for a safety net assembly has a swivel link attachment to an external net-support frame of the net assembly so that when the external net-support frame is mounted on an exterior of a building the attachment members can be swiveled to appropriate angles in the interior of the building. Each elongated attachment member has at a second, or outer, end thereof a traction-force responsive grappling member for selectively gripping and disengaging a stationery object, such as an steel beam flange, located in the interior of the building. To move the external net support frame to a new vertical location the elongated rigid support attachment members, or spars, are disengaged from the external net support and the external net support is attached to extra attachment spars at a new vertical location. A truss structure couples adjacent lateral net support spars. Corner net units are included.

BRIEF DESCRIPTION OF THE DRAWINGS

The foregoing and other objects, features and advantages of the invention will be apparent from the following more particular description of a preferred embodiment of the invention, as illustrated in the accompanying drawings in which reference characters refer to the same parts throughout the different views. The drawings are not necessarily to scale, emphasis instead being placed upon illustrating principles of the invention in a clear manner.

DESCRIPTION OF THE PREFERRED EMBODIMENT

Figures 1, 2:
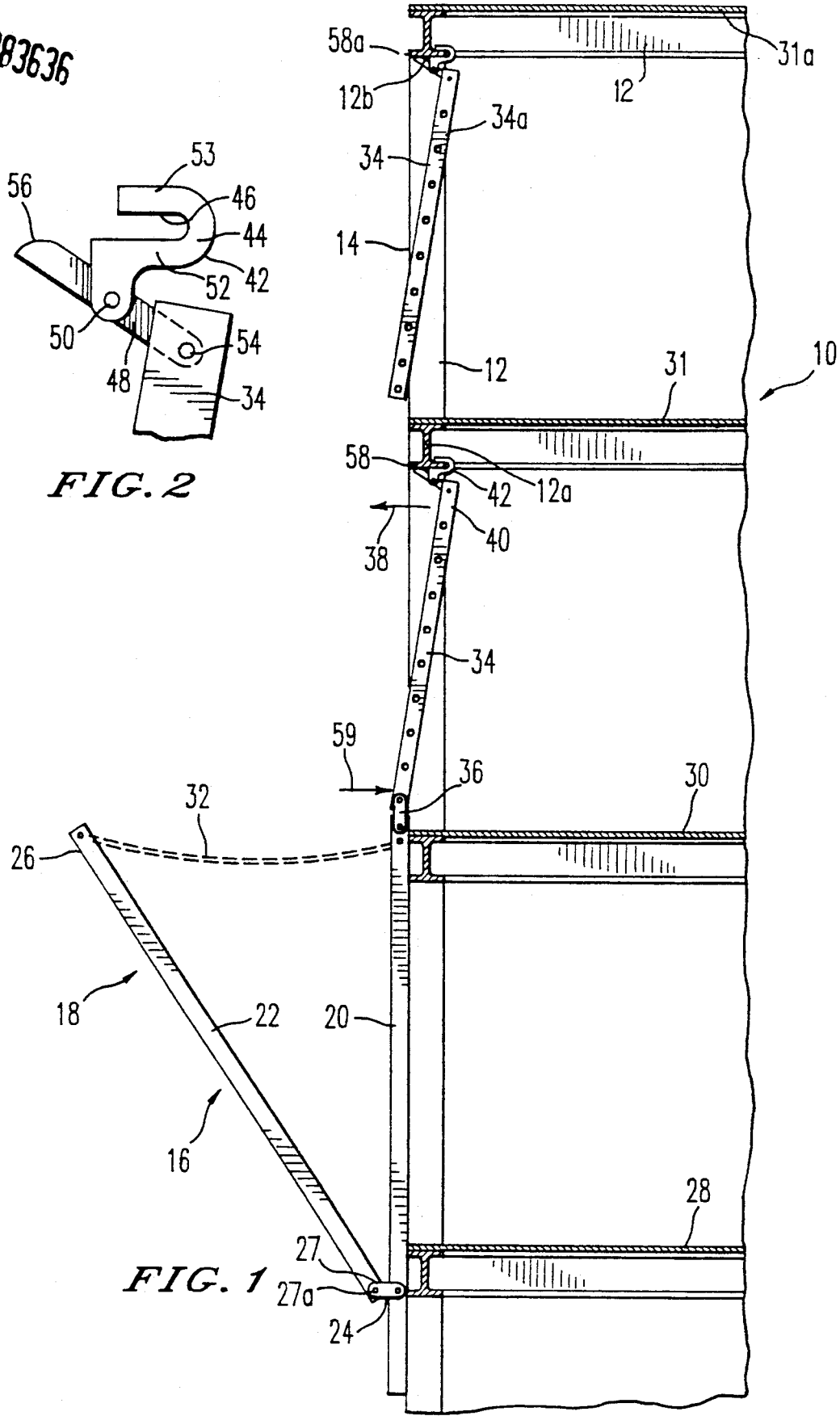
FIG. 1 is a schematic, side, partially sectional, view of a building having a climbing safety net of this invention mounted thereon.
FIG. 2 is an enlarged side view of a traction force responsive hook clamp of the climbing safety net assembly of FIG. 1.

A partially completed building 10 includes steel I-beam columns 12 and has mounted thereon a safety net assembly 16. The safety net assembly 16 comprises an external net-support frame 18 including a vertical net support spar 20 and a lateral net support spar 22 which is mounted at an exterior side surface 14 of the building 10. The lateral net support spar 22 is attached to the vertical net support spar 20 by a net-support swivel link 24 which allows the lateral net support spar 22 to pivot relative to the vertical net support spar 20 so that it can be pivoted diagonal thereto with an outer end portion 26 positioned laterally away from the vertical net support spar 20. The swivel link 24, in one embodiment, is nothing more than two steel plates 27, one on each side of the lateral and vertical support spars 20 and 22 with pins 27*a* passing through each of the plates and the respective support spars. The pins can be ¾ inch machine bolts. It should be understood that a net assembly unit 16*a* (FIG. 4) can be constructed of many such external net supports 18*a–d* (FIG. 4) which are aligned approximately horizontally, parallel, to one another on a building at a same vertical level. In FIG. 1, the vertical level is such that the vertical net support spars 20 extend at least between first and second floors, or levels, 28 and 30 so as to hold a mesh net 32, which is attached to upper end portions of the vertical net support spars 20 and the outer end portions 26 of the lateral net support spars 22, below the second floor 30, third floor 31, fourth floor 31*a*, etc. A cable (not shown) runs between adjacent vertical net support spars at a building surface to which the net 32 is clipped in order to hold the net between the vertical spars tightly against the building. In this manner, the mesh net 32 is positioned so as to catch persons and/or objects falling from the building 10 from above the net 32. In this respect, under proposed government standards, the net 32 must be sufficiently strong to catch a 400 pound object falling 25 feet.

In a preferred embodiment, the vertical and lateral net support spars 20 and 22 are constructed of hollow steel tubes which are 2 ½ inch square in cross section with ¼ inch thick walls. In a preferred embodiment, the vertical net support spars 20 are 24 feet long and the lateral net support spars 22 are also 24 feet long. As is mentioned above, the vertical and lateral net support spars 20 and 22 are adjacent to other similar support spars to form a net assembly unit with a plurality of single nets 32. A plurality of such net support spars will support adjacent nets 32, each of which is 15×30 feet, for example. The support spars are located horizontally on approximately 30 feet centers.

The safety net assembly 16 further includes attachment members, or spars, 34 each of which is coupled to a vertical net support spar 20 by means of an attachment-spar swivel link 36 (similar to swivel link 24) which allows the attachment member, or spar, 34 to swivel into the interior of the building 10 to be at any angle necessary for achieving an appropriate attachment to the building 10. The attachment spars 34 are constructed of the same square tube stock as the vertical and lateral net support spars 20 and 22. In one embodiment an outer end portion 40 of each elongated attachment spar 34 has pivotally attached thereto a weight-responsive grapple in the form of a clamp hook 42 which is shown in further detail in FIG. 2. The clamp hook 42 includes a U-shaped hook 44 defining a mouth 46 with a lever clamp 48 being pivotally attached at 50 to a leg 52 thereof. Each attachment spar 34 is pivotally attached to an outer end portion of its respective lever clamp 48 at 54 so that if a traction, or pulling, force is applied to the attachment spar 34 a nose 56 positioned at an upper end of the lever clamp 48 is caused to tightly impinge, or clamp, on an object in the mouth 46. In this respect, the clamp hook 42 is normally placed on an inside edge of a lower flange 58 of a horizontal steel beam, such as an I-beam girder 12*a*, which helps support a floor, such as the third floor 31 for example, at an outer wall of the building 10 on which the safety net assembly 16 is mounted. With this assembly, weight of the external net support 18, as well as the net 32 and the attachment spar 34, places a traction force on the lever clamp 48 to tightly clamp the clamp hook 42 on the lower flange 58 of the I-beam girder 12*a*. In this position, since an upper end of the attachment spar 34 is swiveled into the interior of the building 10, an inward, lateral, moment of force 59 is provided at an upper end of the vertical net support spar 20 causing the external net support 18 to be held against the outer surface of the building 10. Also, an outward, lateral, moment of force at 38 is provided at the clamp hook 42 tending to drive the clamp hook 42 onto the I-beam flange 58. In other words, the U-shaped hook 44 itself responds to traction force applied to the attachment spar 34 by more tightly gripping the lower flange 58, aside from action of the lever clamp 48.

Figure 3:
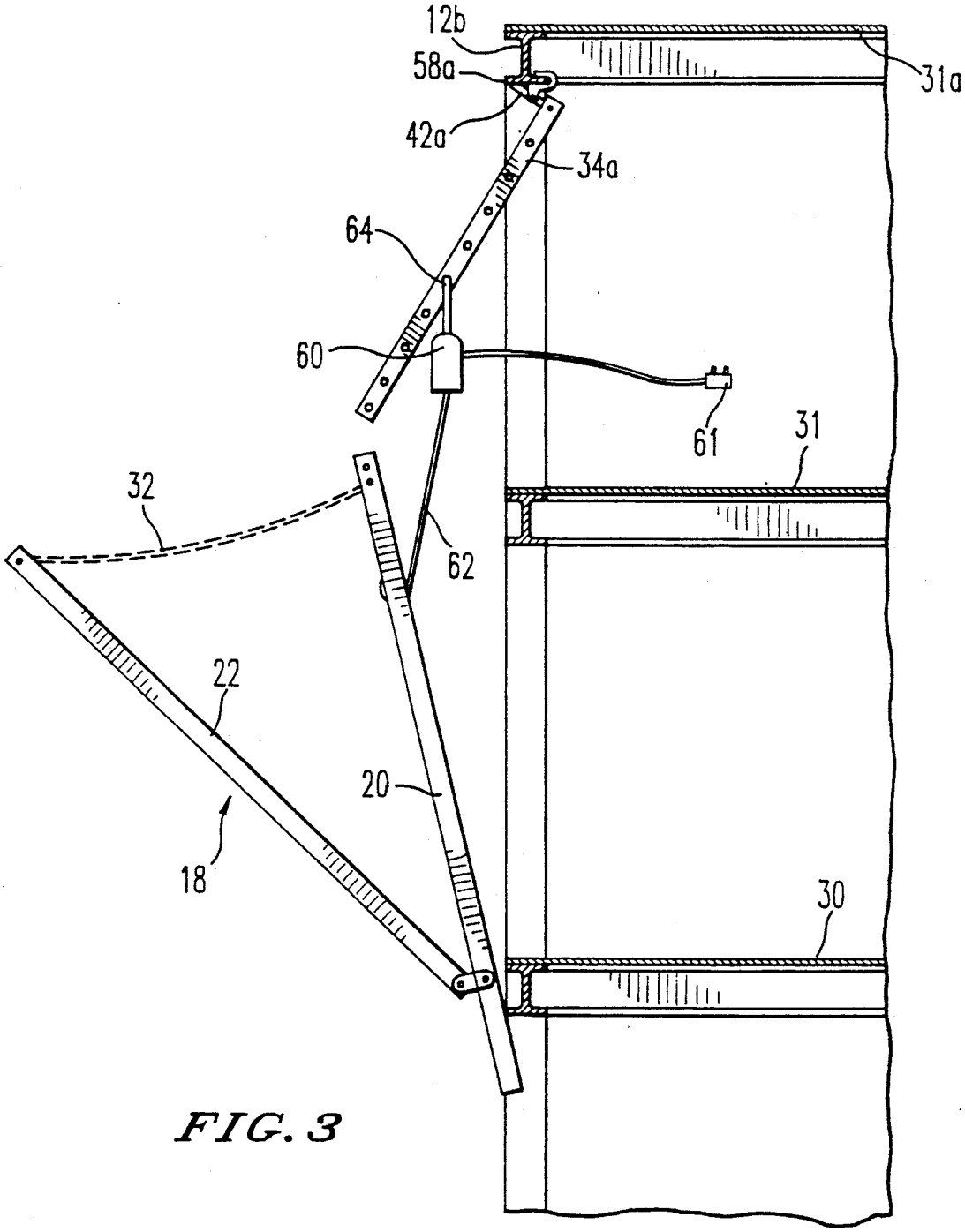
FIG. 3 is a schematic side view similar to FIG. 1, but including a winch with a pulley, during a process of vertically adjusting a position of the safety net of this invention.

The structure thus far described is sufficient for holding the safety net assembly 16 at a vertical level on a building. However, it is often necessary to change the vertical level of the net assembly 16 as floors of a building are completed. In order to do this, the safety net assembly 16 further includes extra attaching spars 34*a*, pulleys 60, of a winch for example, and pulley tethers 62. The extra attaching spars 34*a* are mounted on a lower flange 58*a* of a horizontal I-beam 12*b* above a floor 31 to which the safety net assembly is to be vertically moved, as is shown in FIG. 1. Mounting these extra attaching spars on the lower flange 58*a* can be accomplished relatively easily since the extra attachment spars 34*a* are rigid, allowing one to do this while standing on the floor 31. The extra attachment spars 34*a* are simply extended upwardly until the mouths 46 of the clamp hooks 42*a* enclose the lower flange 58*a*. The pulleys 60 are mounted on the extra attaching spars 34*a* by means of brackets 64 (FIG. 3). The pulley tethers 62 are hooked to vertical net support spars 20 as shown in FIG. 3 and the pulleys, or winches 60, are then driven using a control 61 to apply a tension to the pulley tethers 62, thereby lifting the vertical net support spars 20, relieving traction from the attachment spars 34 and, in turn, tending to relieve traction from the lever clamps 48 of the clamp hooks 42. The clamp hooks 42 are then removed from the lower flange 58 of the I-beam girder 12*a*, thereby disengaging the attachment spars 34 from the I-beam girder. Also, the attachment spars 34 can be removed at the attachment-spar swivel links 36 from the vertical net support spars 20 by removing pins thereof. The winches, or pulleys, 60 are then used to drive the winch, or pulley, tethers 62 to locate the vertical net support spars 18 and their attached net 32 to a new vertical location. Once at this new vertical location, lower ends of the extra attachment spars 34*a* are approximately adjacent upper ends of the vertical net support spars 20 so that attachment-spar swivel links 36 can be attached to the attachment spars 34*a*. Thereafter, the pulleys, or winches, 60 are reversed to relieve tension on the winch tethers 62 thereby allowing gravity to pull downwardly on the external net support 18 applying clockwise torques to the lever clamps 48 of the clamp hooks 42 to more tightly grip the flange 58 of the I-beam girder. When it is again desired to move the external net support 18 and its attached net 32 to a new location, these steps are repeated, with the attachment spars 34 becoming the extra attachment spars 34*a*.

Figure 4:
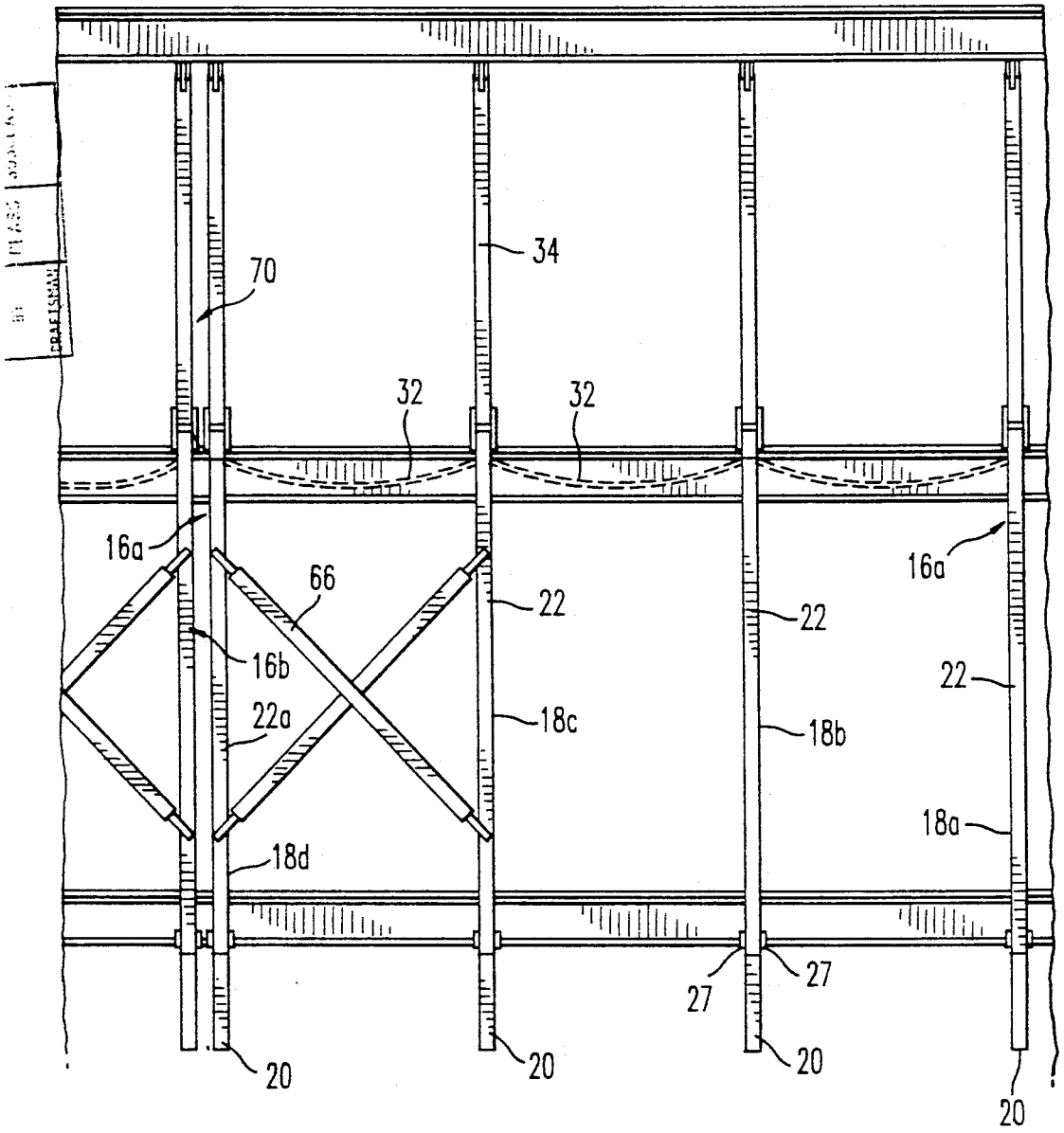
FIG. 4 is a front elevation of a building having a safety net of this invention mounted thereon.

From what has already been described, it can be understood that safety net units of this invention can easily be moved to new vertical positions. However, adjacent safety net units must butt solidly against one another so as not to leave gaps between units. Safety nets of the prior-art have solved this problem by clipping end edges of safety net units together once they are in position. Although this works, it is time consuming to clip end edges together and unclip them later when the net units are to be vertically adjusted. To overcome this, a truss structure 66, shown in FIG. 4, is provided at end edges of safety net units. In this regard, the safety net units themselves do not tend to move away from one another but rather outer end portions 26 of end lateral net support spars 22 (see FIG. 1) tend to be rotated by attached nets 32 inwardly toward centers of net units. This cross truss structure 66 extends between lateral net support spars 22 of a pair of exterior net supports 18*c* and d which are at the end of a net unit 16*a* (see FIG. 4). The cross truss structure 66 prevents an end lateral support spar 22*a* from rotating to the right as viewed in FIG. 5 thereby maintaining the net 32 of net unit 16*a* closely adjacent to an adjacent safety net unit 16*b*.

Figure 5:
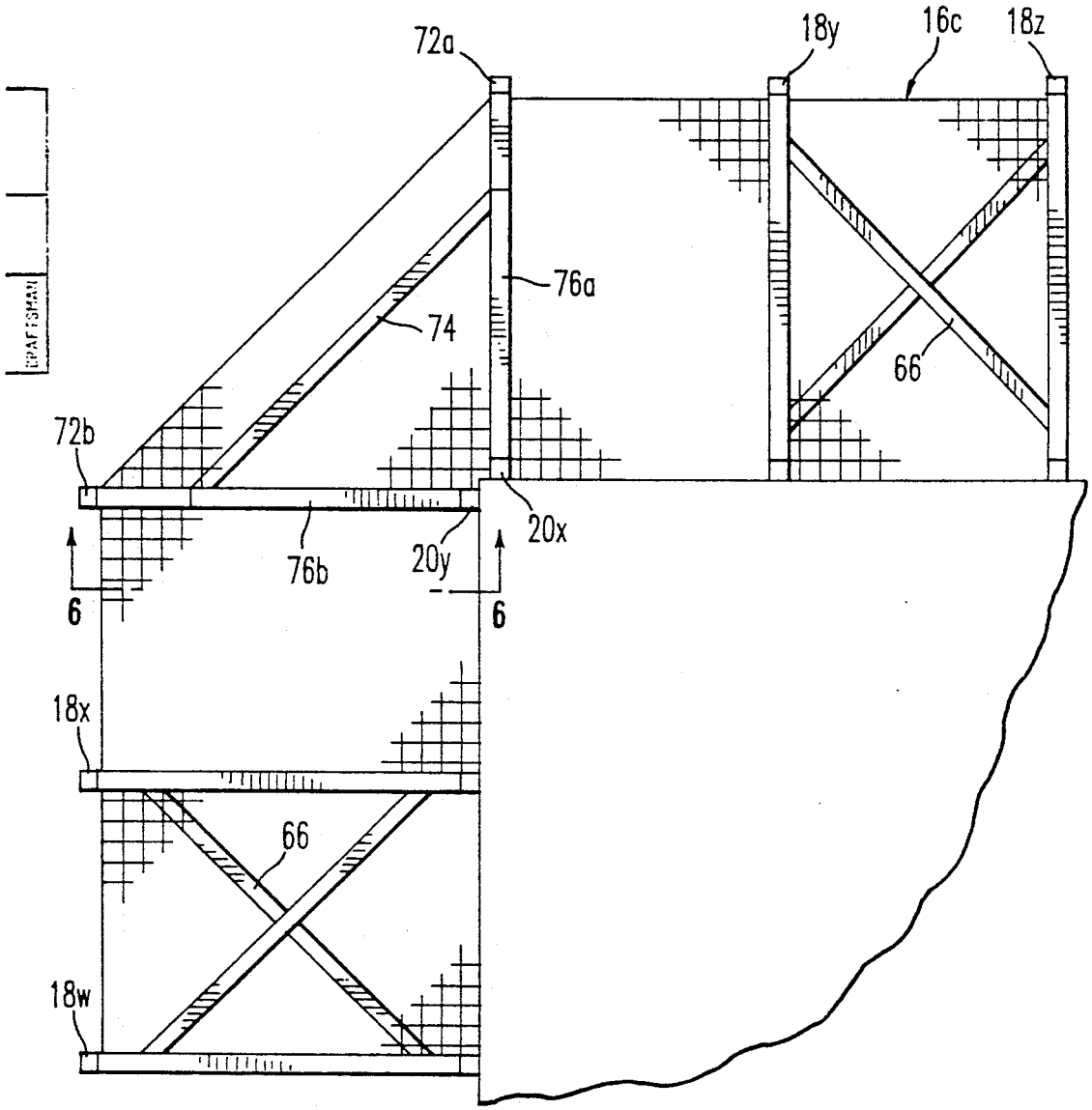
FIG. 5 is a top view of a corner unit of this invention on a building.
Figure 6:
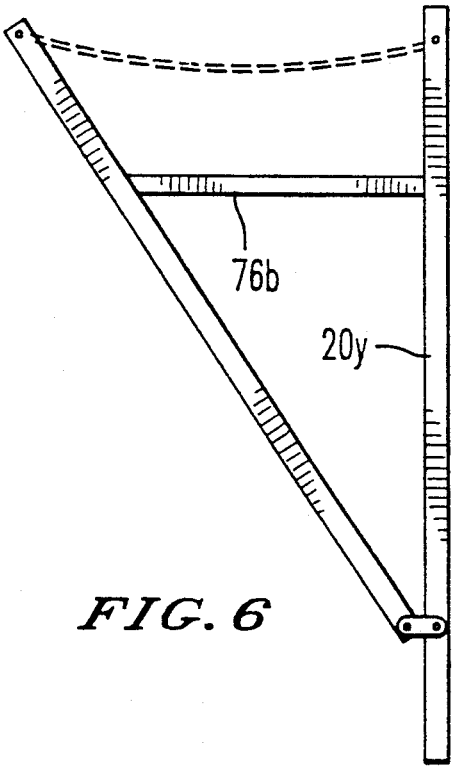
FIG. 6 is a view taken on 6—6 in FIG. 5.

FIGS. 5 and 6 depict a corner unit 16*c* in which corner lateral net support spars 72*a* and 72*b* are supported to extend laterally perpendicular to one another by a diagonal spar 74 and from their respective vertical net support spars 20 X and Y by respective horizontal support spars 76 *a* and *b*. Also part of the corner safety net unit 16*c* of FIGS. 5 and 6 are additional exterior net supports 18 w, x, y and z. The exterior net supports 18 W and X form end pairs which must have support against lateral torque and for this reason cross trusses 66 as shown in FIG. 4 are employed.

Figure 7:
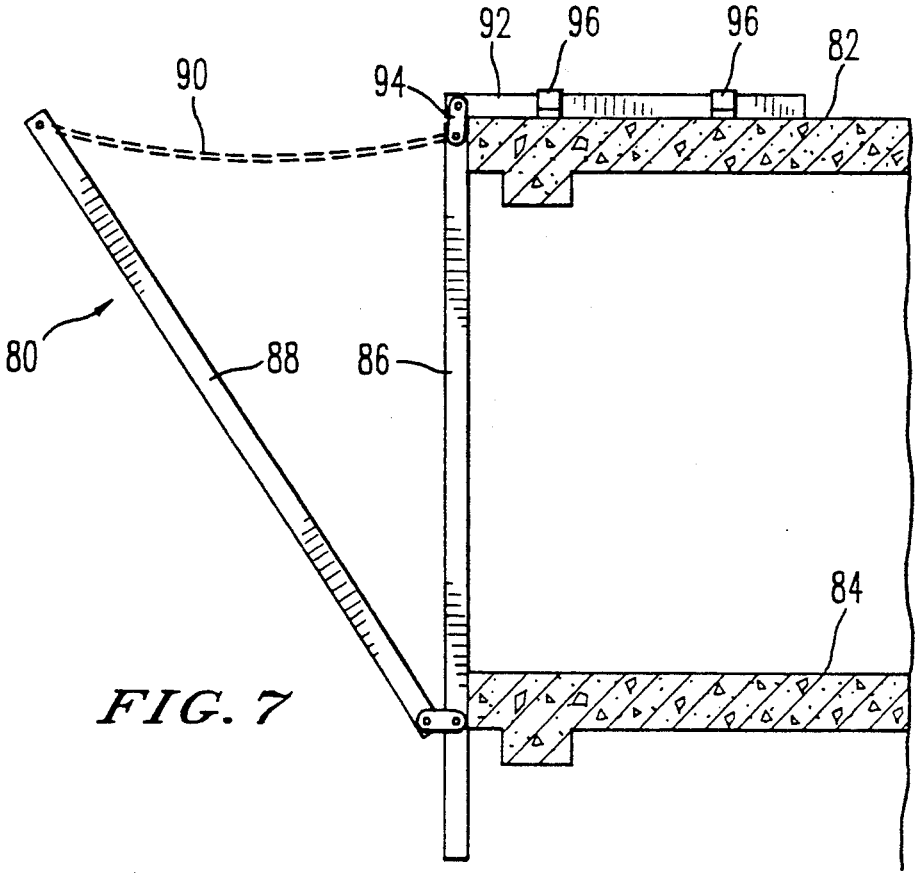
FIG. 7 is a schematic, side, view of a building having a second embodiment climbing safety net of this invention mounted thereon.

FIG. 7 depicts a second embodiment of this invention in which a safety net assembly 80 is mounted on a building whose floors 82, 84, etc. are constructed of reenforced concrete so that there are no steel beams having flanges to which a clamp hook could attach. In this embodiment, vertical net support spars 86, lateral net support spars 88, and a net 90 are basically the same as corresponding elements in the embodiment of FIGS. 1–3. Also, attachment members, or spars, 92 are also basically the same as the attachment spars 34 of the FIGS. 1–3 embodiment with the exception that they do not have grapples, or clamp hooks, at their outer ends. However, they are constructed of hollow, steel tubes which are rigid along their lengths and are respectively coupled to upper ends of the vertical net support spars 86 by means of attachment spar swivel links 94. In use, the safety net assembly 80 is attached to the floor 82 by pivoting the attachment spars 92 at the attachment-spar swivel links 94 relative to the vertical net support spars 86 so that the attachment spars 92 are approximately perpendicular to the vertical net support spars 86, as shown in FIG. 7. Clamps, or grapples, 96 are then bolted, or otherwise attached to a top surface of the floor 82, thereby clamping the attachment spar 92 to the top surface of the floor 82. Bolts could also be extended directly through the attachment spar 92 into the floor 82. It will be appreciated by those of ordinary skill in the art, that since the attachment spar 92 is rigid, it can be easily held on the floor 82 for supporting the safety net assembly 80 during this attaching process. In this regard, a worker can stand on the attachment spar 92 while it is being attached to the floor 82.

The safety net assembly 80 is adjusted vertically by attaching pulleys to floors located above a floor at which a net is to be located.

It will be understood that it is also possible to use two sets of extra attachment spars, one for supporting pulleys and pulley tethers for vertically adjusting the position of the safety net assembly 80 and the other set of attachment spars being actually attached to the safety net assembly 80.

It will be understood by those of ordinary skill in the art that the safety net assembly of this invention offers tremendous benefits over safety nets of the prior art. By employing a weight responsive grapple to hold a safety net in a vertical location an extremely secure attachment of the safety net to a building is achieved because the more downward force placed on the safety net the firmer it is held in position. Similarly, it is extremely beneficial to use a clamp hook which can be mounted on a lower flange of an I-beam because most modern buildings include horizontal I-beam girders on exterior walls thereof which allow ready attachments for safety net assemblies of this invention. In the same manner, it is quite beneficial to employ an attachment member which is rigid but which has a selective swivel attachment with an external net support. With its rigid structure, the attachment member can be extended upwardly for attaching it to an overhead beam without the use of a ladder, which would be quite dangerous near an open wall of a building. The swivel attachment allows the attachment member to be at whatever angle is necessary for achieving a satisfactory attachment. By making the swivel attachment selectively releasable, one can easily install extra attachment members at a new vertical level and attach the exterior net support thereto.

It is also helpful to employ a rigid attachment spar as the attachment member because this adds rigidity to the attachment and provides a lateral force holding the external net support against the exterior surface of a building.

Still another beneficial aspect of this invention is the use of a traction-force responsive grapple on the attachment member because such an attachment device does not require time-consuming and damaging boring of holes in a building.

Also beneficial are truss structures at end edge lateral supports of safety net units for preventing these lateral supports from rotating inwardly toward middles of the net units.

It is also beneficial to have a corner safety net unit which can be raised and lowered as a unit without disassembly thereof.

While the invention has been particularly shown and described with reference to a preferred embodiment, it will be understood by those skilled in the art that various changes in form and detail may be made therein without departing from the spirit and scope of the invention. For example, the relative lengths of the attachment spars could be different than those described herein. Further, it would also be possible for a traction-force grapple to merely be a hook since a hook, if properly applied, is force responsive, becoming more securely hooked when weight is appropriately applied thereto.

The safety net assemblies of this invention can also be used on interior walls of buildings for large spaces, such as lobbies.

It should be understood that in the embodiment depicted in FIG. 3, winches 60 with pulleys are attached directly to attachment spars 34. However, it would also be possible to simply attach pulleys thereto and have winches therefor attached somewhere else. Further, it is also possible for this invention to employ hand operated winches as well as electrically operated winches.

The clamp hook 42 of this invention could be of a type manufactured by J. C. Renfroe and Sons, Inc. of Jacksonville, Florida.

The embodiments of the invention in which an exclusive property or privilege are claimed are defined as follows:

1. A climbing safety net assembly comprising:

an elongated vertical net-support spar means for extending vertically along an outer surface of a building;

an elongated lateral net-support spar means being attached at an inner end portion thereof to said vertical net-support spar means and at an outer end portion thereof, spaced laterally from said vertical net support spar means, to a net;

said net extending between said vertical net-support spar means and said outer end portion of said lateral net-support means for catching objects falling from said building above said net;

a rigid elongated attachment means including, a swivel link at a first end portion thereof linked to said vertical net support spar and further including a grappling means spaced from said swivel link for engaging a stationary object located in the interior of said building;

whereby said climbing safety net can be mounted on a building with said attachment means being swiveled into the interior of said building with said grappling means fastening to a stationary object therein.

2. A climbing safety net assembly as in claim 1 wherein said grappling means is force-responsive for engaging said object more securely when a traction force is applied thereto along said elongated attachment means and less securely when said traction force is relieved therefrom;

3. A climbing safety net assembly as in claim 2 wherein said force-responsive grappling means is a clamping hook for hooking and clamping a flange of a steel beam.

4. A climbing safety net assembly as in claim 3 wherein said safety net assembly further includes a pulley mountable on a separate elongated attachment means and pulley tether for raising and lowering said net.

5. A climbing safety net assembly as in claim 1 wherein said safety net assembly further includes a pulley mountable on a separate elongated attachment means and pulley tether for raising and lowering said net.

6. A climbing safety net assembly as in claim 1 wherein a safety net unit comprises a plurality of adjacent elongated vertical and lateral net-support spars, with a pair thereof located at an end edge of the net unit being supported from one another by a rigid truss to prevent rotation thereof.

7. A climbing safety net assembly comprising:

an elongated vertical net-support spar means for extending vertically along an outer surface of a building;

an elongated lateral net-support spar means being attached at an inner end portion thereof to said vertical net-support spar means and at an outer end portion thereof, spaced laterally from said vertical net support spar means, to a net;

said net extending between said vertical net-support spar means and said outer end portion of said lateral net-support means for catching objects falling from said building above said net;

an elongated attachment means including, a selectively-attachable swivel link at a first end portion thereof linked to said vertical net support spar and further including a selective fastening means spaced from said swivel link for selectively fastening said elongated attachment means to a stationary object located in the interior of said building;

a pulley mountable on said elongated attachment means;

whereby said climbing safety net can be mounted on a building with said attachment means being swiveled into the interior of said building with said fastening means being fastened to a stationary object therein and can thereafter be moved to a new vertical location on said building by fastening an extra elongated attachment means to said stationary object, mounting a pulley on said extra elongated attachment means, detaching said swivel link from said attachment means, using said pulley for moving said climbing safety net to said new location, and attaching said swivel link to an extra elongated attachment means.

8. A method of changing a vertical position of an exterior safety net on a building which is supported by a rigid elongated attachment member selectively coupled to said building, said method comprising the steps of:

mounting a pulley on an extra rigid elongated attachment member coupled to said building at a location above a present location of the safety net;

using the pulley and a pulley tether thereof, lifting the safety net a small amount so as to relieve traction pressure on said attachment member and detaching said attachment member from said safety net;

using said pulley and said pulley tether, moving said safety net to said new vertical location along said building;

attaching an extra attachment member to said safety net at said new location.

9. A method as in claim 8 wherein said extra rigid elongated attachment member on which said pulley is mounted is the same as said extra rigid elongated attachment member to which said safety net is attached.

* * * * *